US008061932B1

(12) United States Patent
Latham

(10) Patent No.: US 8,061,932 B1
(45) Date of Patent: Nov. 22, 2011

(54) HYDRAULIC BOAT LIFT

(76) Inventor: Robert P. Latham, Fort Lauderdale, FL (US)

( * ) Notice: Subject to any disclaimer, the term of this patent is extended or adjusted under 35 U.S.C. 154(b) by 260 days.

(21) Appl. No.: 12/456,574

(22) Filed: Jun. 19, 2009

(51) Int. Cl.
*B63B 23/02* (2006.01)

(52) U.S. Cl. ..... 405/3; 114/369; 114/259

(58) Field of Classification Search ..... 405/1, 3; 114/259, 365, 366, 368, 369, 370, 373
See application file for complete search history.

(56) References Cited

U.S. PATENT DOCUMENTS

| | | | | |
|---|---|---|---|---|
| 4,627,377 | A * | 12/1986 | Zoonens | 114/369 |
| 5,275,505 | A | 1/1994 | Wilcox | |
| 5,919,000 | A | 7/1999 | Unkle | |
| 6,327,992 | B1 | 12/2001 | Martin | |
| 6,474,256 | B1 * | 11/2002 | Vogel | 114/369 |
| 6,782,842 | B1 * | 8/2004 | Alvord | 114/369 |
| 6,786,170 | B2 * | 9/2004 | Trowbridge | 114/259 |
| 6,964,239 | B2 * | 11/2005 | Vinnik | 405/3 |
| 7,293,521 | B1 * | 11/2007 | Johns et al. | 114/259 |
| 7,331,295 | B1 | 2/2008 | Marchiori | |
| 7,707,955 | B1 * | 5/2010 | Johns et al. | 114/259 |
| 2003/0192466 | A1 * | 10/2003 | Trowbridge | 114/366 |
| 2004/0089212 | A1 * | 5/2004 | Vinnik | 114/44 |
| 2006/0147269 | A1 * | 7/2006 | Spratt et al. | 405/3 |
| 2008/0105186 | A1 * | 5/2008 | Johns et al. | 114/259 |

* cited by examiner

*Primary Examiner* — Frederic L Lagman
(74) *Attorney, Agent, or Firm* — Alvin S. Blum

(57) ABSTRACT

A hydraulic boat lift assembly will raise and lower a boat cradle remotely, and will securely lock the cradle in an uppermost storage position. The lift as provided with a manual mechanism for unlocking the cradle from its uppermost storage position for operation when the hydraulic system is not available. The lift has a support frame that is mountable on the outside of the transom of a boat with hydraulic connections to a hydraulic system and controls within the boat. A lift mechanism connected to the support frame raises and lowers a cradle that supports a small boat or tender. The lift mechanism includes one or more hydraulic lift cylinders. In a retracted position of the lift cylinder, the cradle is elevated above the water in a storage position when the boat is under way. To ensure security of the tender, the lift mechanism employs a lock cylinder that prevents inadvertent motion of the lift cylinder from the retracted position by mechanical and hydraulic mechanisms. The lock cylinder must be deliberately unlocked by the hydraulic system before the lift cylinder will lower the cradle. A manual unlock mechanism is provided for use when the hydraulic system is unavailable and the tender must be launched.

3 Claims, 9 Drawing Sheets

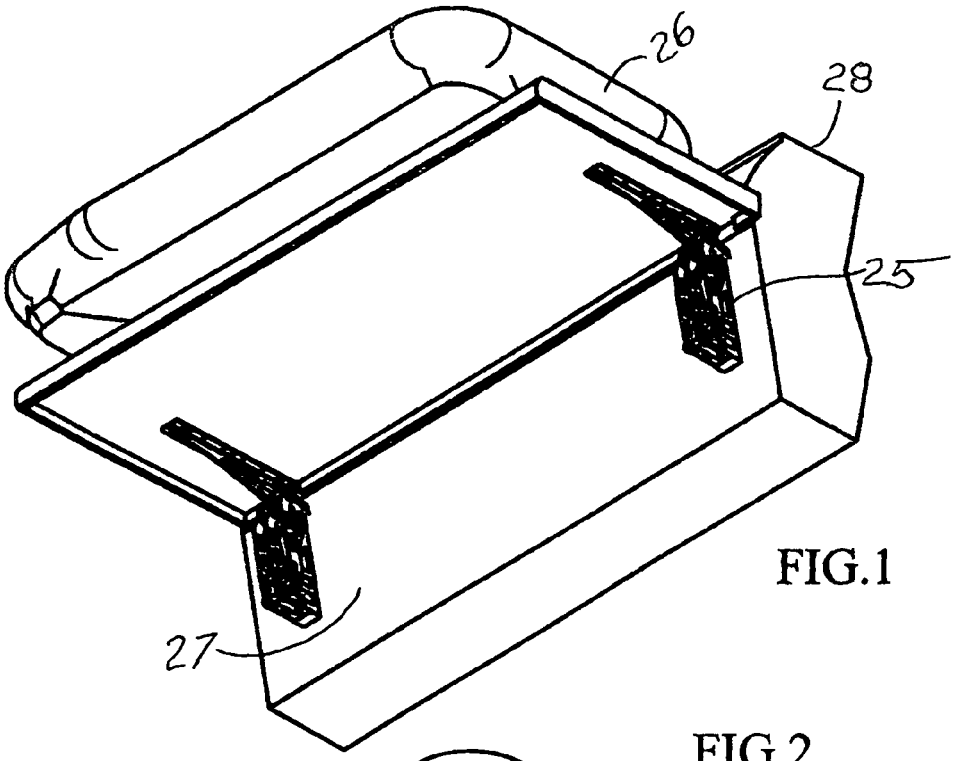
FIG.1
FIG.2
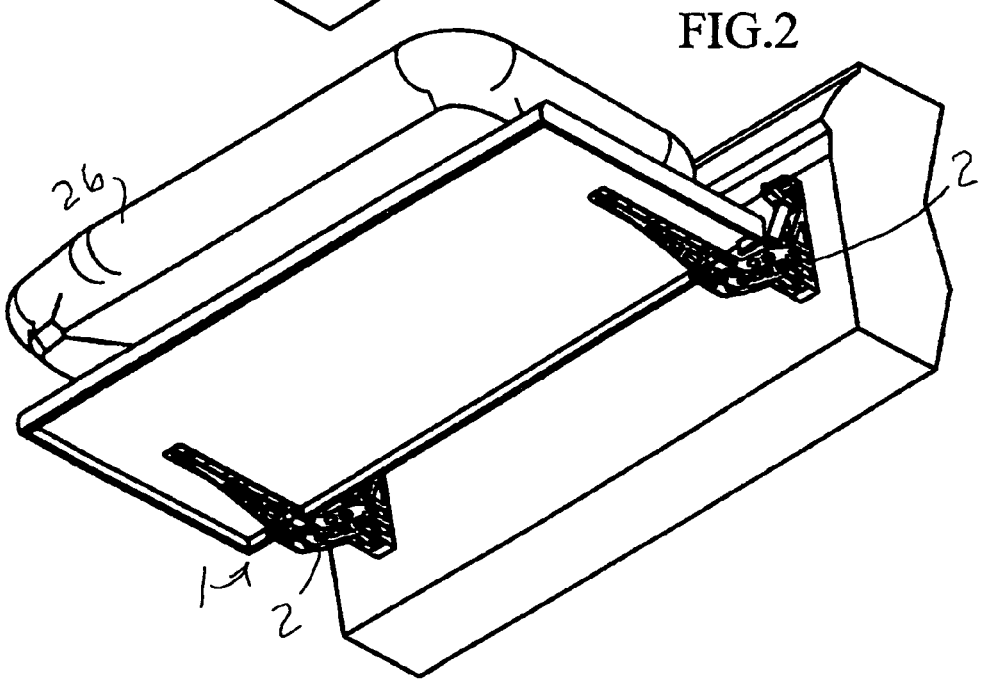

HYDRAULIC BOAT LIFT

FIELD OF THE INVENTION

This invention relates to hydraulic lifts for raising and lowering a boat into and out of the water, and more particularly to a hydraulic mechanism for locking the lift in the elevated position.

BACKGROUND

Small boats are often carried on larger vessels. They may be stored on a deck, and provided with a device that picks up the boat swings, it over the side or stern, and the lowers it into the water. Alternatively, the boat may be stored above the water in a cradle in a lift assembly mounted on the outside of the larger vessel's transom. The lift assembly may be powered by one or more hydraulic cylinders. Because the vessel may be subjected to vigorous motions, it is desirable to be able to lock the cradle securely in the uppermost storage position when underway. It would also be useful to be able to raise and lower the boat remotely with hydraulic controls.

SUMMARY OF THE INVENTION

It is accordingly an object of the invention to provide a hydraulic boat lift assembly that will raise and lower a boat cradle remotely, and that will securely lock the cradle in an uppermost storage position. It is another object that the lift be provided with a manual mechanism for unlocking the cradle from its uppermost storage position for operation when the hydraulic system is not available. The lift has a support frame that is mountable on the outside of the transom of a boat with hydraulic connections to a hydraulic system and controls within the boat. The hydraulic passages through the transom and within the lift are devoid of flexible hydraulic hoses for maximum security and durability. A lift mechanism connected to the support frame raises and lowers a cradle that supports a small boat or tender. The lift mechanism includes one or more hydraulic lift cylinders. In a retracted position of the lift cylinder, the cradle is elevated above the water in a storage position when the boat is under way. To ensure security of the tender, the lift mechanism employs a lock cylinder that prevents inadvertent motion of the lift cylinder from the retracted position by mechanical and hydraulic mechanisms. The lock cylinder must be deliberately unlocked by the hydraulic system before the lift cylinder will lower the cradle. A manual unlock mechanism is provided for use when the hydraulic system is unavailable and the tender must be launched.

BRIEF DESCRIPTION OF THE DRAWINGS

FIG. 1 is a perspective view from below of the elevated lift.

FIG. 2 is a perspective view from below of the lowered lift.

DETAILED DESCRIPTION OF PREFERRED EMBODIMENTS

Figures 3, 4:
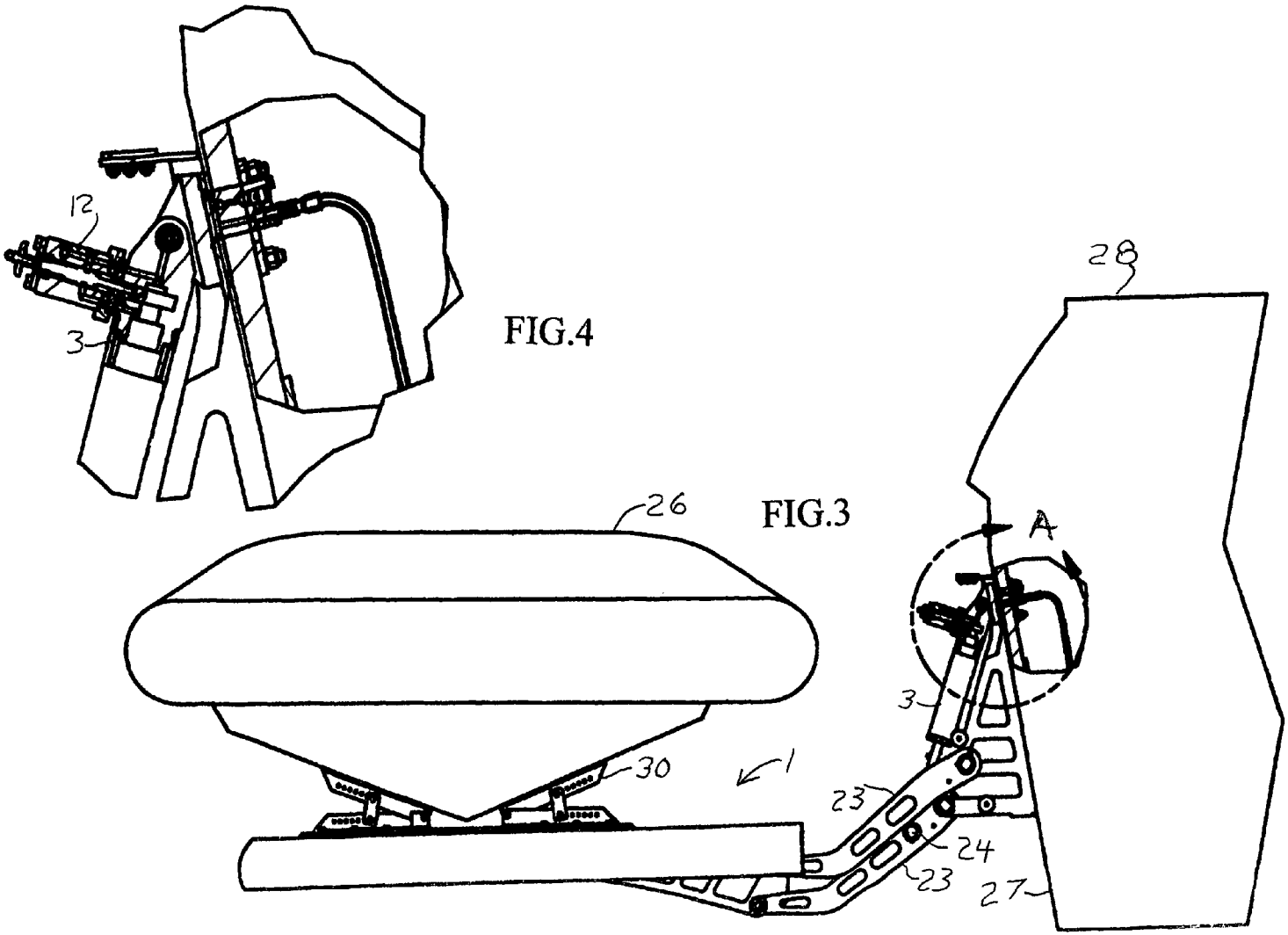
FIG. 3 is a side view of the lowered lift.
FIG. 4 is a detail view of the area A of FIG. 3.
Figure 5:
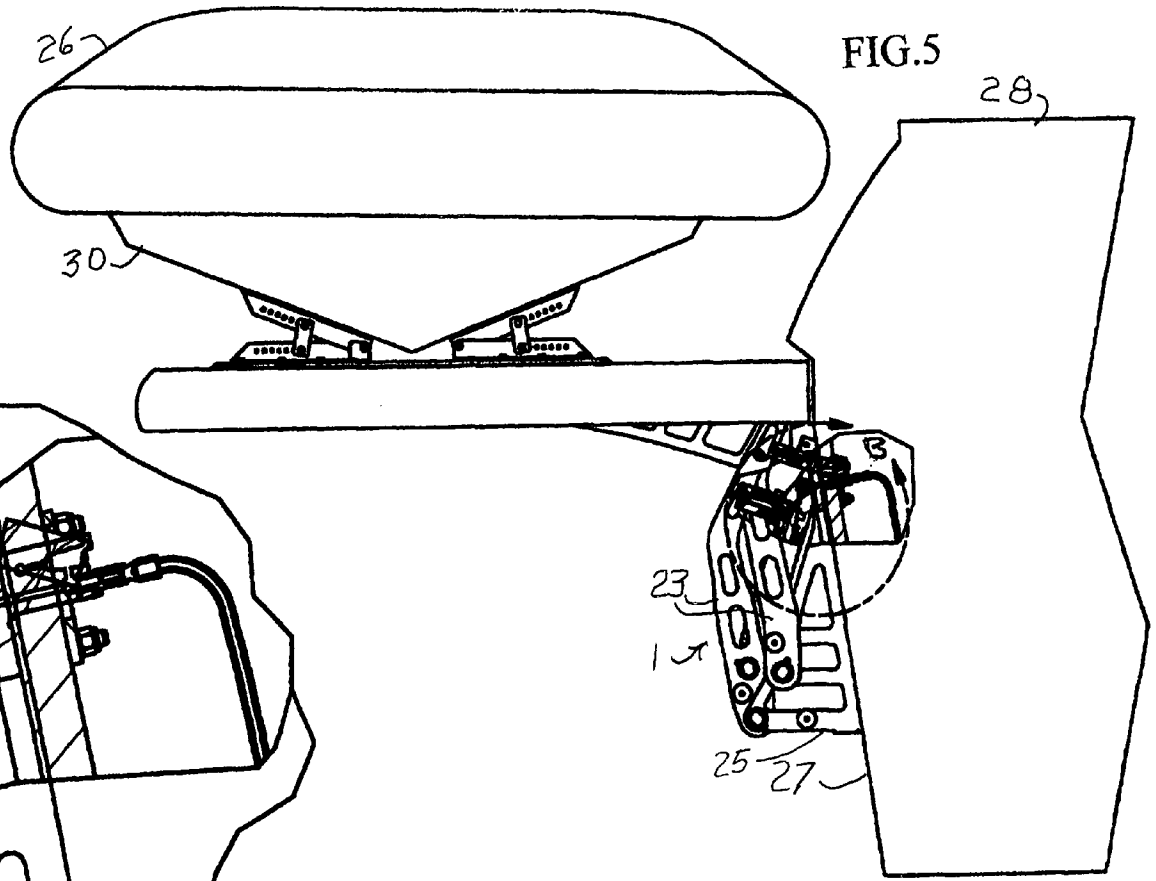
FIG. 5 is a side view of the elevated lift
Figure 6:
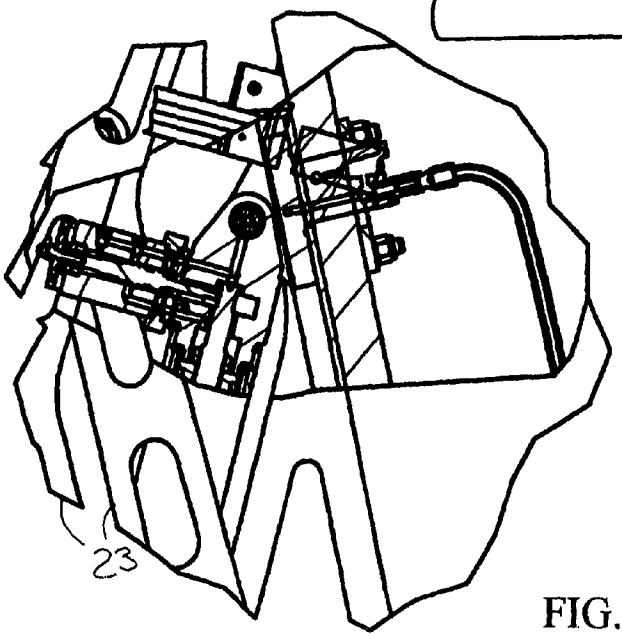
FIG. 6 is a detail view of the area B of FIG. 5.

Referring now first to the drawing FIGS. 1-9, vessel 28 has a transom 27. Bolted onto the outside of the transom is a support frame 25 of a boat lift 1 of the invention. A boat cradle 30 is pivotally connected by lift mechanisms 2 with connecting links 23 to the support frame in a pantographic arrangement so that the cradle will remain horizontal as it is moved from an elevated position of FIGS. 1 and 4 above the water to a lower position of FIGS. 2 and 3 where a small boat, or tender, 26 resting on the cradle will be at or near the water surface for launching. Raising and lowering the cradle is accomplished by hydraulic lift mechanisms 2. There may be one or more lift mechanisms.

Each lift mechanism 2 includes a hydraulic lift cylinder 3 pivotally connected at a first end 7 to the support frame 25. A lift piston 4 is sealingly disposed for translatory motion under hydraulic fluid force within the lift cylinder. A first piston rod 6 affixed at a first end to the piston 4 extends through seal 8 from a second end of the cylinder 3 to pivotal connection 24 at a second end 10 to a connecting link 23. Extension and retraction of rod 6 causes the cradle 30 to lower and to raise respectively. A second piston rod 9 extends from a second end of the lift piston and lies completely within the cylinder 3 during motion of the piston. A recess 17 at the free end of 9 will be used to lock the lift in the elevated position. Rods 6 and 9 lie in a common axis with the central axis of cylinder 3.

Figure 13:
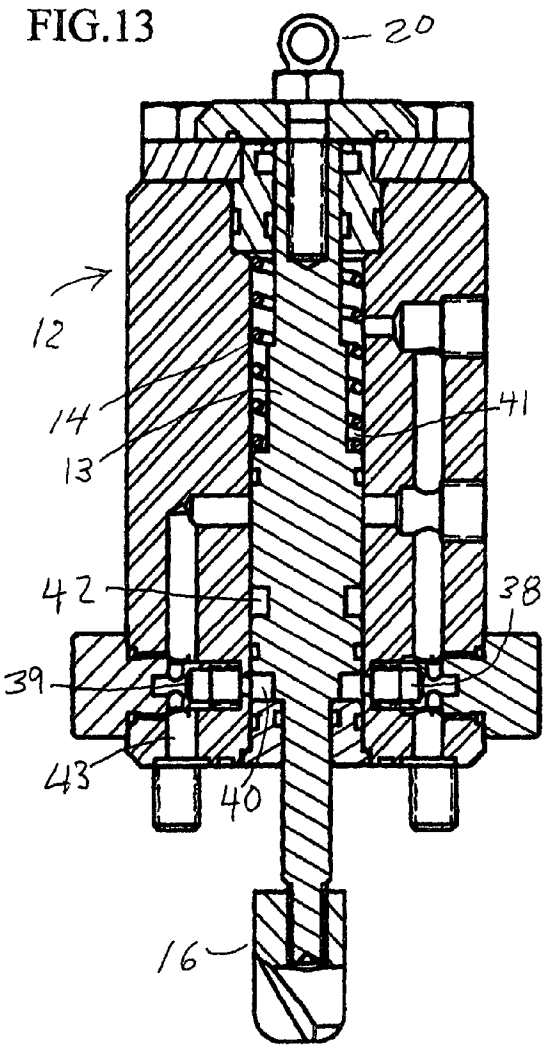
FIG. 13 is a sectional view through line C-C of FIG. 12.
Figure 12:
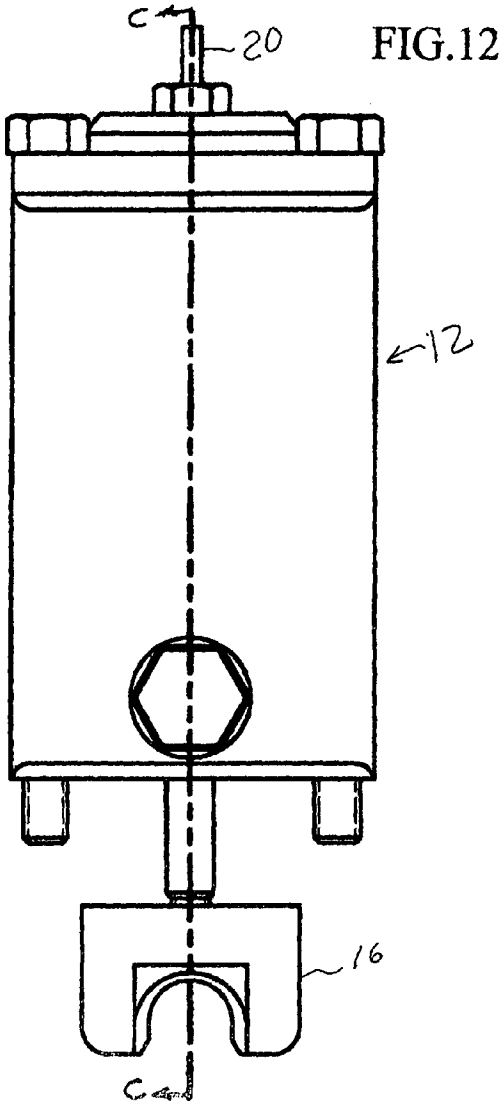
FIG. 12 is a side view of a lock cylinder in lock mode.
Figure 15:
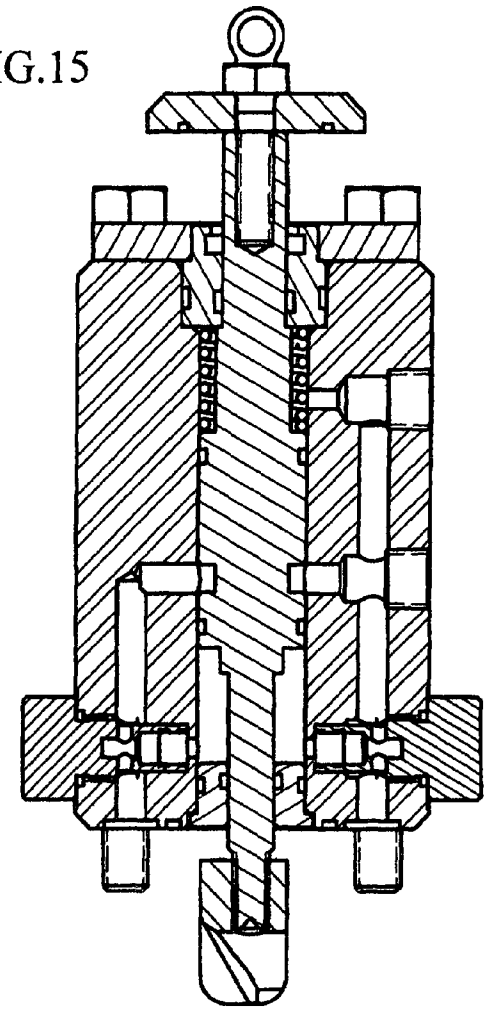
FIG. 15 is a sectional view through line D-D of FIG. 14.
Figure 14:
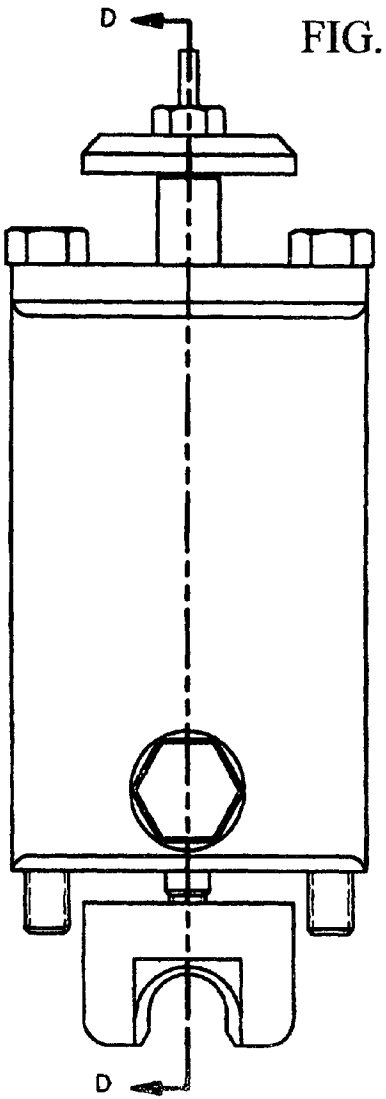
FIG. 14 is a side view of a lock cylinder in unlock mode.

A lock cylinder 12 is fixedly disposed adjacent the lift cylinder. A lock piston 13 is sealingly disposed within the lock cylinder 12 for reciprocating motion therein under hydraulic fluid force and spring bias between an extended lock position (FIGS. 9, 12, and 13), and a retracted unlock position (FIGS. 10, 11, 14, and 15). A first lock piston rod 15 extends from a first end of lock piston 13 with a rod engagement member 16 at a free end thereof. This rod engagement member 16 passes into lift cylinder 3 and is received in the recess 17 of the free end of rod 9 when lock piston rod 15 is in extended position to prevent motion of the lift mechanism. A compression spring 14 forces the lock piston 13 and rod 9 to the extended and lock position when there is no hydraulic fluid force. The spring 14 may be a metal spring or a non-metal spring such as a polyurethane spring, as desired. A second lock piston rod 18 extends from a second end of lock piston 13 with a free end that extends out from a free end of lock cylinder 12 through a fluid seal 19 and terminates in pull fixture 20 to enable manual unlocking when hydraulic fluid force is unavailable. The lock piston serves an additional function of blocking the flow of hydraulic fluid through the lift cylinder when the lock piston is extended. That function will be detailed below.

Figure 8:
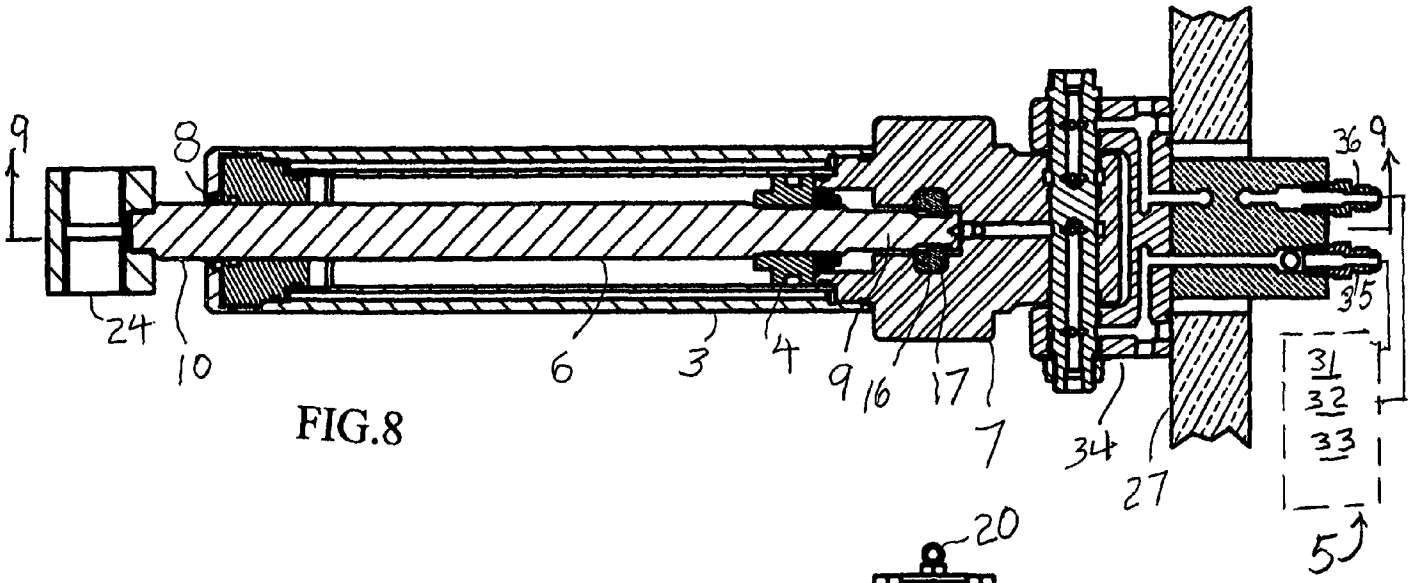
FIG. 8 is a sectional view through line AF-AF of FIG. 7 with elevated lift locked.
Figure 7:
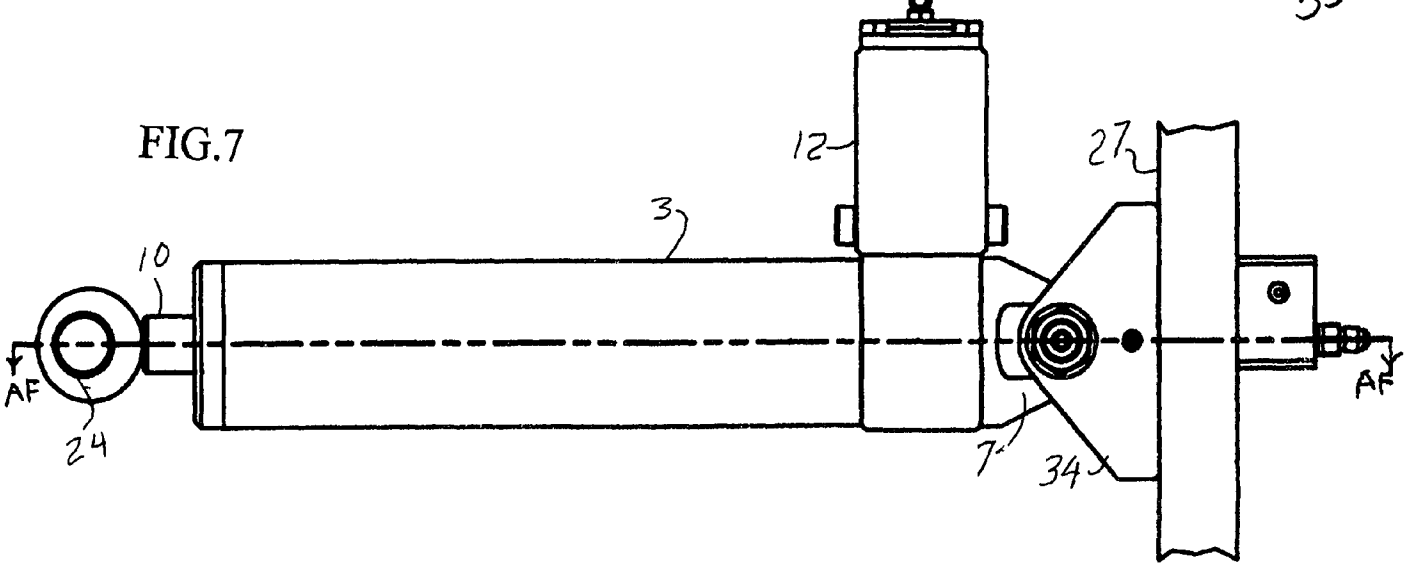
FIG. 7 is a side view of the lift cylinder and lock cylinder combination in elevated position.
Figure 9:
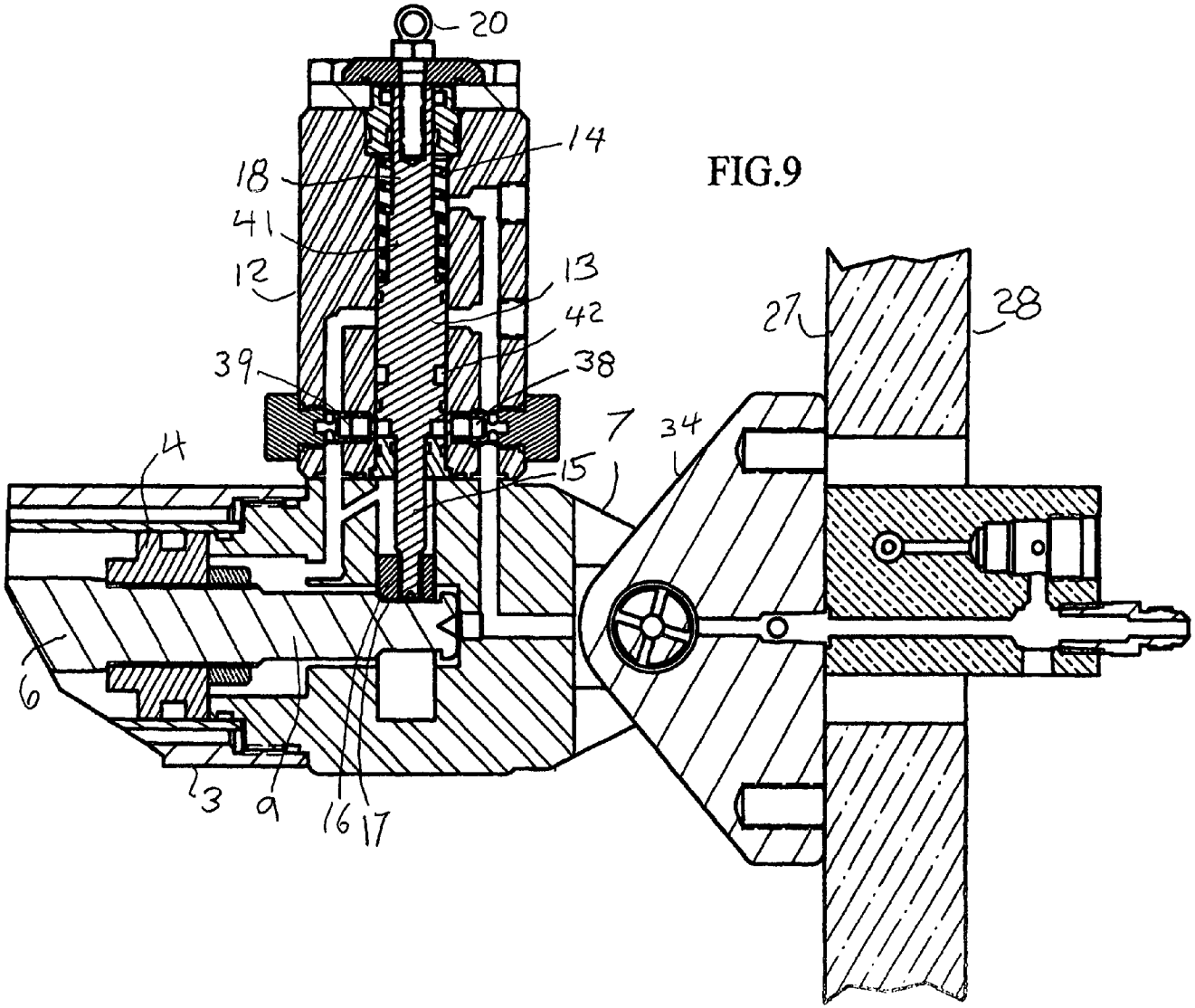
FIG. 9 is a partial sectional view through line 9-9 of FIG. 8.
Figure 10:
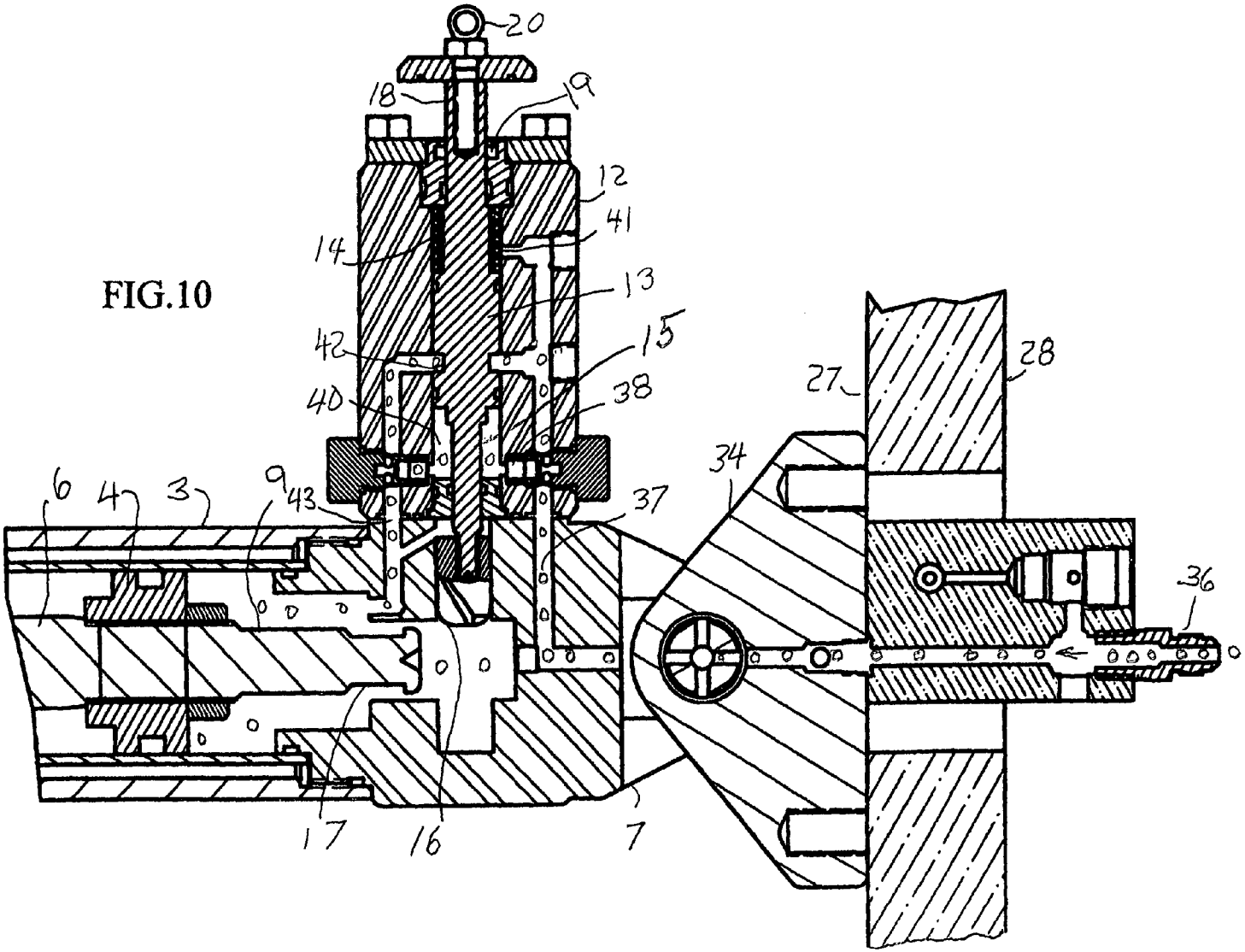
FIG. 10 is a sectional view as in FIG. 9 with lift piston moving and lift lowering.
Figure 11:
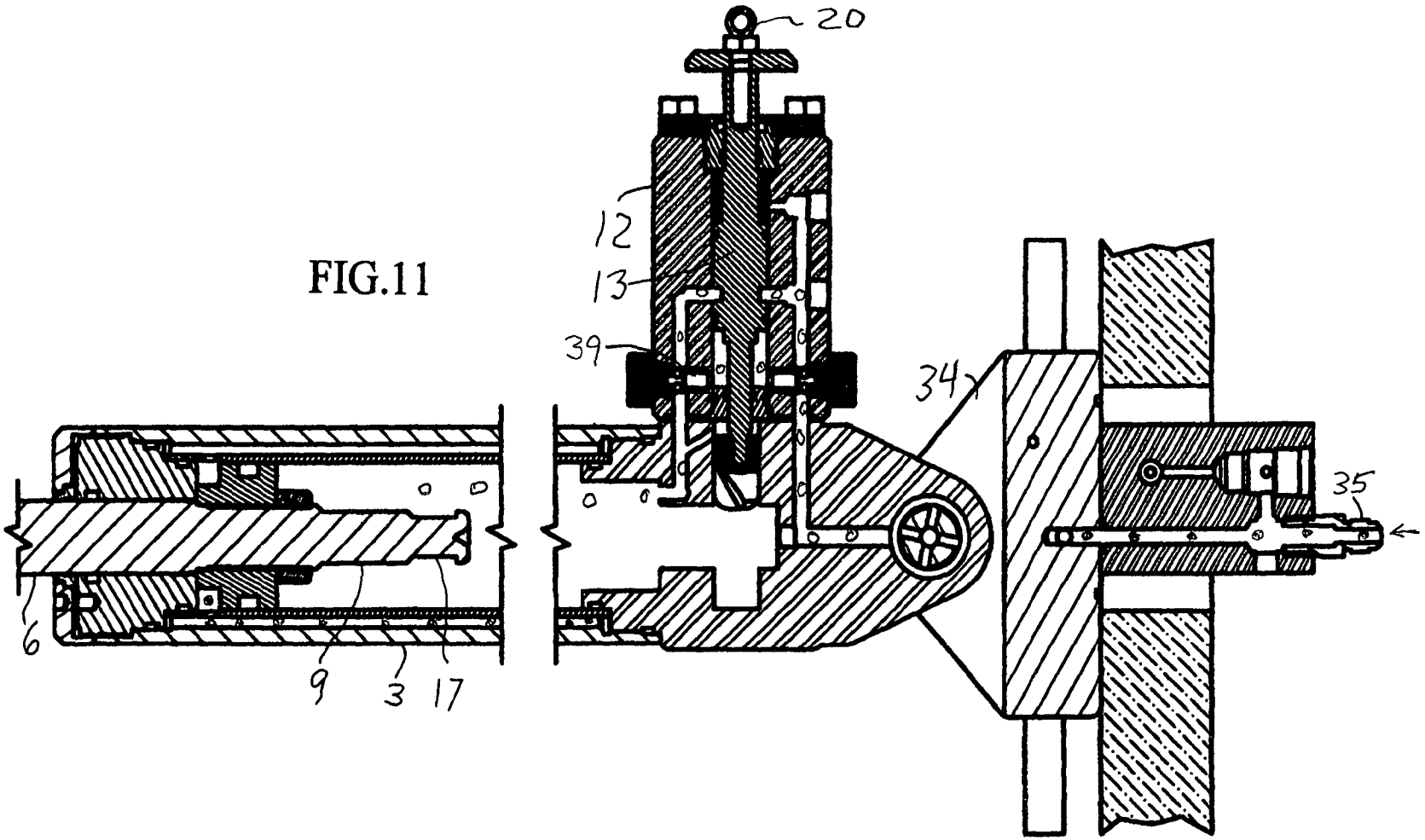
FIG. 11 is a sectional view as in FIG. 9 with lift lowered, piston fully extended, and beginning to lift.

As shown in FIGS. 7 through 10, the hydraulic fluid circuit 5 includes a hydraulic pump 31, fluid reservoir 32, and controls 33 of a type sufficiently well known in the art that details need not be given here. A first hydraulic passage 35 and a second hydraulic passage 36 through the transom 27 are removably connected to the hydraulic circuit 5. The controls 33 enable one of the two passage 35 to receive hydraulic fluid under pressure while the other passage 36 passes return hydraulic fluid to the reservoir 32 to cause the lift cylinder to raise the cradle. To lower the cradle, the controls reverse the order of hydraulic fluid flow with passage 36 receiving hydraulic fluid pressure and passage 35 fluid returning to reservoir. As shown in FIG. 8, the passages 35 and 36 are in fluid communication with a rotary valve 34 that is affixed to the support frame 25. The rotary valve 34 is of a type well known in the art for connecting two fixed passages containing fluid under pressure through an arc of rotation to two other passages without the use of flexible hoses. Not all the details are visible in the drawings. The rotary valve 34 incorporates the first end 7 of the lift cylinder to connect passage 36 to lift channel 37 that extends up into the lock cylinder 12 past right check valve 38 which only passes fluid left into a chamber formed by a reduced diameter portion 40 of the first lock piston rod 15. Pressurized fluid path is indicated by a series of small circles. Fluid continues up to the reduced diameter portion 41 at the other end of the lock piston. Because the area of the piston exposed to the fluid pressure at 40 is greater than at 41, the pressure difference will force the piston 13 upward to the fully retracted position shown in FIGS. 10 and 15. The rod engagement member 16 is withdrawn from the recess 17 in the piston rod 9 so that the lift piston is free to move. Spring 14 is compressed and annular passage 42 in piston 13 is now in position to allow pressure fluid in lift channel 37 access to channel 43 that is in fluid communication with the right side of lift piston 4 to extend rod 6 and lower the cradle. When the lift is at the lowered position shown in FIG. 11, pressurized fluid, as shown by closed circles, from passage 35 will be applied to the left side of lift piston 4 when the cradle is to be lifted. Fluid on the right side of piston 4, as shown by open circles, will be forced up through channel 43 and then through left check valve 39 to force lock piston 13 up until passage 42 is open to enable flow of return hydraulic fluid to the reservoir of the hydraulic circuit 5.

The invention claimed is:

1. A boat lift comprising:

a boat cradle;

a support frame adapted for affixing to a vessel;

at least one lift mechanism operatively connecting the cradle and the support frame for raising the boat cradle to an uppermost position and for lowering the cradle;

the lift mechanism including:

a hydraulic lift first cylinder having a lift piston sealingly disposed therein for reciprocating motion by hydraulic fluid force of a hydraulic fluid circuit;

a first piston rod extending from a first end of the lift piston and passing sealingly through an end wall of the first cylinder to raise and lower the cradle;

a second piston rod extending from a second end of the lift piston and lying completely within the first cylinder;

the first and second piston rods lying along a common axis with a long axis of the lift cylinder;

a lock cylinder disposed adjacent to the lift cylinder;

a lock piston sealingly disposed within the lock cylinder for reciprocating motion therein under hydraulic fluid force to a retracted position and spring bias to an extended position;

a first lock piston rod extending from a first end of the lock piston and having a rod engagement member connected to a free end thereof;

the rod engagement member constructed to be received in a recess in the second piston rod when the first piston rod is in a most retracted position to thereby prevent motion of the lift piston when the first lock piston rod is in a most extended position; and the hydraulic fluid circuit so constructed that fluid for operating the lift piston is only free to flow through the lift cylinder when the lock piston rod is retracted.

2. A boat lift comprising:

a boat cradle;

a support frame adapted for affixing to a vessel;

at least one lift mechanism operatively connecting the cradle and the support frame for raising the boat cradle to an uppermost position and for lowering the cradle;

the lift mechanism including:

a hydraulic lift first cylinder having a lift piston sealingly disposed therein for reciprocating motion by hydraulic fluid force of a hydraulic fluid circuit;

a first piston rod extending from a first end of the lift piston and passing sealingly through an end wall of the first cylinder to raise and lower the cradle;

a second piston rod extending from a second end of the lift piston and lying completely within the first cylinder;

the first and second piston rods disposed along a common axis with a long axis of the lift cylinder;

a lock cylinder disposed adjacent the lift cylinder;

a lock piston sealingly disposed within the lock cylinder for reciprocating motion therein by hydraulic fluid force and spring bias;

a first lock piston rod extending from a first end of the lock piston and having a rod engagement member at a free end thereof;

the rod engagement member constructed to be received in a recess in the second piston rod when the first piston rod is in a most retracted position to thereby prevent motion of the lift piston when the first lock piston rod is in a most extended position;

a second lock piston rod extending from a second end of the lock piston, the first and second lock piston rods disposed along a common axis with a long axis of the lock cylinder;

the second lock piston rod passing sealingly through an end of the lock cylinder and having a pull fixture at a free end thereof for pulling the rod engagement member free of the second piston rod for unlocking the lift piston; and the hydraulic fluid circuit so constructed that fluid for operating the lift piston is only free to flow through the lift cylinder when the lock piston rod is retracted.

3. A boat lift comprising:

a boat cradle;

a support frame;

at least one lift mechanism operatively connecting the cradle and the support frame for raising the boat cradle to an uppermost position and for lowering the cradle;

the lift mechanism including:

a hydraulic lift first cylinder having a lift piston sealingly disposed therein for reciprocating motion under hydraulic fluid force;

a first piston rod extending from a first end of the lift piston and passing sealingly through an end wall of the first cylinder to raise and lower the cradle;

a second piston rod extending from a second end of the lift piston and lying completely within the first cylinder;

the first and second piston rods disposed along a common axis with a long axis of the lift cylinder;

a lock cylinder disposed adjacent the lift cylinder;

a lock piston sealingly disposed within the lock cylinder for reciprocating motion therein by hydraulic fluid force of a hydraulic fluid circuit and spring bias;

a first lock piston rod extending from a first end of the lock piston and having a rod engagement member connected to a free end thereof;

the rod engagement member constructed to be received in a recess in the second piston rod when the first piston rod is in a most retracted position to thereby prevent motion of the lift piston when the first lock piston rod is in a most extended position;

a second lock piston rod extending from a second end of the lock piston, the first and second lock piston rods disposed along a common axis with a long axis of the lock cylinder that is transverse to the axis of the lift cylinder;

the second lock piston rod passing sealingly through an end of the lock cylinder and having a pull fixture at a free end thereof for pulling the rod engagement member free of the second piston rod for unlocking the lift piston;

the hydraulic fluid circuit providing fluid to both ends of the lock piston; and the hydraulic fluid circuit so constructed that fluid for operating the lift piston can only flow through the lift cylinder when the lock piston rod is retracted.

* * * * *